United States Patent [19]

Pearl

[11] Patent Number: 4,621,809

[45] Date of Patent: Nov. 11, 1986

[54] BENCH CONSTRUCTION FOR USE IN WEIGHT LIFTING

[76] Inventor: William A. Pearl, 178 Hummingbird La., Talent, Oreg. 97540

[21] Appl. No.: 540,357

[22] Filed: Oct. 11, 1983

[51] Int. Cl.[4] ..... A63B 13/00

[52] U.S. Cl. ..... 272/123; 272/144

[58] Field of Search ..... 272/144, 134, 145, 93, 272/123; 128/68-70, 33, 22; 5/431, 432; 297/423, 458, 464; D21/197

[56] References Cited

U.S. PATENT DOCUMENTS

| | | | |
|---|---|---|---|
| 885,243 | 4/1908 | Haas . | |
| 1,904,039 | 10/1930 | Bruder | 128/69 |
| 2,533,273 | 12/1950 | MacGregor . | |
| 2,771,875 | 10/1951 | Cason | 128/33 X |
| 2,785,418 | 4/1954 | Goguen | 5/443 |
| 3,042,025 | 7/1962 | Jackson | 128/70 X |
| 3,117,782 | 1/1964 | Johnston | 272/81 |
| 3,601,121 | 8/1971 | Roberts | 128/33 |
| 3,890,004 | 6/1975 | Rail | 297/423 |
| 4,207,635 | 6/1980 | Leroy . | |
| 4,207,879 | 6/1980 | Safadago et al. | 128/70 |
| 4,275,472 | 6/1981 | Erck | 5/60 |
| 4,295,683 | 10/1981 | Dubbink et al. | 297/377 |
| 4,300,249 | 11/1981 | Taylor . | |
| 4,354,677 | 10/1982 | Young . | |
| 4,367,870 | 1/1983 | Birch . | |
| 4,411,425 | 10/1983 | Milnar | 272/123 |

*Primary Examiner*—Richard J. Apley
*Assistant Examiner*—Robert W. Bahr
*Attorney, Agent, or Firm*—Kolisch, Hartwell & Dickinson

[57] ABSTRACT

A bench construction for use by a lifter reclined thereon in performing weight lifting movements includes a bench top having an upper surface configured with portions anatomically contoured and dimensioned for supporting and at least partially restraining the reclined lifter from lateral and longitudinal shifting. The bench top finds particular application in use for weight lifting movements such as the bench press, and the upper surface includes a lower-body section configured as a first depression contoured for receiving and stabilizing the lifter's buttocks. In addition, the lower-body section includes leg stabilizing sections configured for engaging the lifter's upper legs to predispose and hold them in a predetermined laterally-diverged orientation. Disposed between a first, upwardly facing substantially planar section of the upper surface and the lower-body section is an intermediate, elevated section defined by a bilateral support means for engaging and supporting the lifter's back and trunk beneath the Latissimus dorsi muscles.

12 Claims, 7 Drawing Figures

FIG. 2
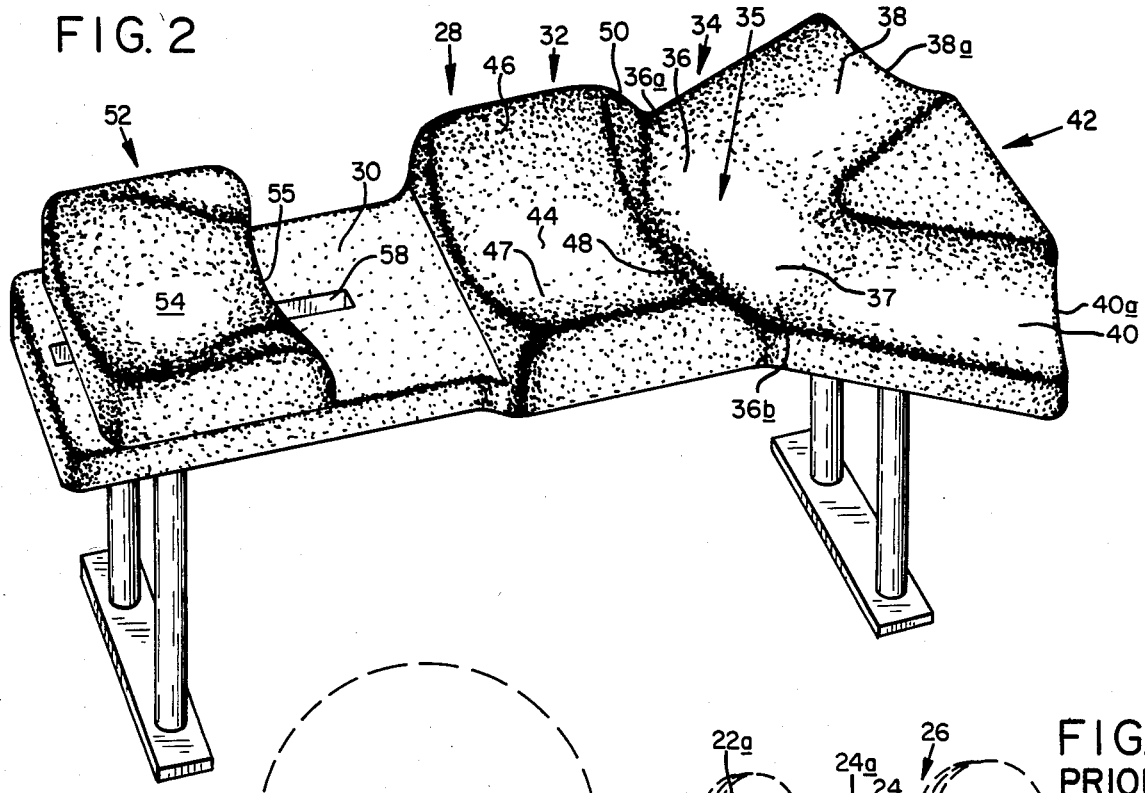
FIG. 1
PRIOR ART
FIG. 3
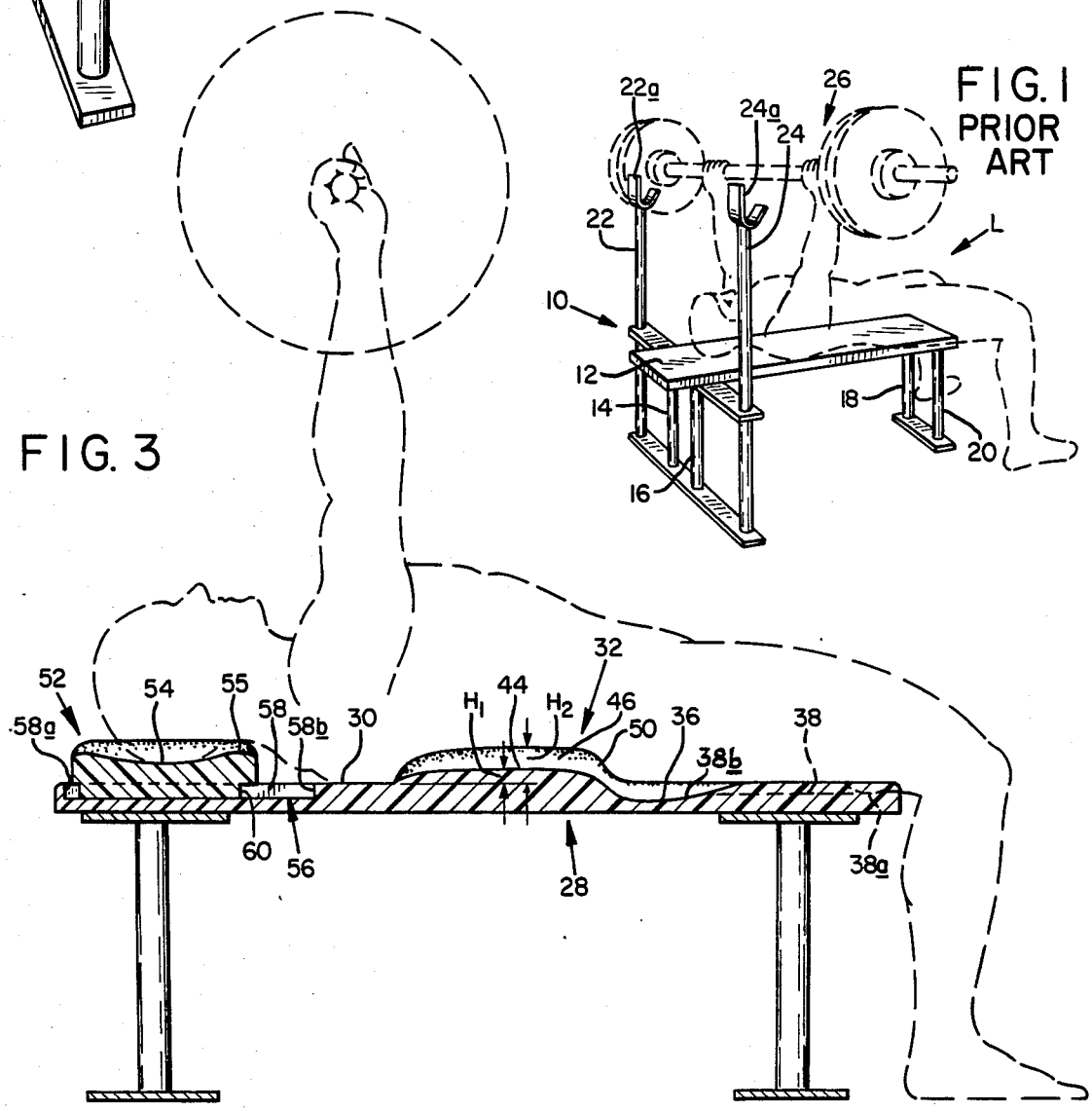

BENCH CONSTRUCTION FOR USE IN WEIGHT LIFTING

BACKGROUND AND SUMMARY OF THE INVENTION

The present invention relates generally to equipment used in weight lifting for strength training, bodybuilding and powerlifting, and more particularly to a novel type of bench construction for use by weight lifters in performing the "bench press" and variants thereof. Specifically, the present invention is directed to a bench construction specially configured for enhancing technique, promoting safety and optimizing muscle development in the performance of the bench press.

Strength training through performing resistance exercises, commonly known as "weight lifting" has long been used as a tool by bodybuilders and is now recognized clearly as being very important in developing strength for athletes and improving an individual's overall well-being and physical condition. Many new types of equipment have been introduced which supposedly increase an individual's ability to gain the benefits from resistance exercises, not the least of which are various types of machines using cams, chains, pulleys, etc. However, it is widely recognized by strength and conditioning authorities that certain basic exercises, using "free-weights" as opposed to "machine-weights," provide the best form of strength training. The reason for extolling free-weights over the use of machines in performing resistance exercises is subject of debate—although the majority of bodybuilders and competitive weight lifters appear to be convinced that use of free-weights provides the optimal approach in developing strength and condition.

Free-weight exercises are those in which the lifter uses only a barbell or dumbbell(s) without any type of machine constraint in performing resistance exercises. The "bench press" has long been a favorite exercise because it develops large muscle groups and is considered to be combination exercise, i.e. the use of more than one muscle group is necessary to complete the lift, and coordinated balance and control are necessary for lift completion. The bench press is probably the most popular weight training exercise, and forms an integral part of the routines of bodybuilders, powerlifters and athletes. To many bodybuilders and others, the amount of weight one can lift in the bench press indicates one's strength and the exercise is considered to be the key chest exercise. The bench press is thought to be the fundamental or foundational exercise for developing and strengthening the upper body muscles, such as those of the chest (Pectoralis major and minor), the back of the arm (Triceps brachii), shoulder (Anterior and middle deltoids) and, to a greater or lesser extent, muscles of the back (Latissimus dorsi).

The bench press can be performed with many different types of equipment, however, as mentioned above, using a free-weight or free-bar on a bench is the mode most widely used in strength training and bodybuilding because it provides the most challenging and complex technique. The bench press is performed by a lifter reclined on an elongate, flat bench positioned approximately 18 inches or thereabouts above the ground. The bench is flat in construction, having a length generally in the range of four feet and a width of 10 inches or thereabouts. The bench is supported horizontally above the ground by means of support legs and typically, support racks or standards, for holding a barbell overhead are positioned at the head end of the bench.

In performing the bench press, the lifter lays on the bench with the head, scapulae (shoulder blades) and buttocks contacting the flat surface of the bench. The lifter's legs are splayed outwardly, i.e. on opposite sides of the bench with the knees flexed so that the lower legs drape vertically downwardly for foot-floor contact. The lifter situates his/her body on the bench, so that the bar, which is "racked" on the support racks is generally disposed above the lifter's eyes. The actual sequence of the bench press movement proceeds biomechanically as follows. The lifter grabs the racked free-bar of the barbell and pushes the weight off the support racks to a starting position above the base of the neck with the arms extended and the elbows locked out. The "down-phase" begins with the lifter lowering the bar slowly under control by the chest, shoulder and arm muscles. The weight is lowered until it just touches or rests on the lower chest area, slightly above the xiphoid process.

Next, in the "press-phase," the weight is pushed upward to the starting position so that the arms are fully extended with the elbows locked. Proper technique requires that the weight be pressed in an even pace and under control using only chest, shoulder and arm strength. In order to isolate the chest, shoulder and arm muscles during both the down- and press-phases, the lifter must concentrate on keeping the remainder body portions isolated from movement, and the trunk and leg musculature act as skeletal stabilizers to allow the upper extremities to work more efficiently.

As described above, only the lifter's head, scapulae and buttocks contact the bench, and the lifter is only supported at those positions. It is considered to be preferable technique to have the back slightly arched, to enable the lifter to use some strength from the latissimus muscles with the feet "locked" under the lifter for stability on the bench (see Hatfield, Powerlifting—A Scientific Approach, 1981). The reason for arching the back is to place some stress on the strong latissimus muscles under the arms. By slightly arching the back, the lifter also uses the latissimus muscles to stabilize the body. However, in order to prevent undue stress on the intervertebral discs, the lifter must not arch the back in an exaggerated manner whereby the buttocks are elevated from the bench surface. If exaggerated arching occurs, the lower area of the spine becomes very vulnerable to injury because of dangerous pressure placed on the spinal discs and adjoining vertebrae.

From the above description of conventional flat benches, it should be apparent that the lifter is only minimally supported, i.e. along the back of the head, the scapulae and the buttocks. The lack of support on such a bench has several very significant drawbacks. First of all, if the lifter is lifting a heavy weight, the tendency is for the lifter to exaggerate the aforementioned arch and thereby create undesirable stress on the lower spine. When this occurs, not only is potential injury probable, but the arms also change position creating improper lifting technique making it somewhat easier to lift the weight but reducing muscle development in the pectorals. Moreover, with the inadequate support of a flat bench, the lifter is able to shift the upper legs as well as the head and trunk resulting in poor technique. The shifting may occur both in the longitudinal and lateral directions relative to the bench, and can actually result in a portion of the lifter's body shifting to one side, thereby placing undue stress on the back and shoulder muscles. Injury may result from such shifting inasmuch as stress is placed more on one side of the body than the other.

Another drawback resulting from the use of conventional flat benches may occur if a lifter has a preexisting injury. For example, if a lifter has an injured shoulder or arm, performance of the bench press may result in one arm lagging behind the other during the press-phase of the lift. The lagging arm may tend to cause the lifter's body to rotate, along the longitudinal axis of the lifter's body, thereby accentuating poor technique and compensatory overwork by the arm and attendant muscles on the opposite side of the body. In addition, as briefly mentioned above, a flat bench provides no lateral support for the lifter's head, resulting in the lifter being able to laterally shift or move the head which interferes with technique.

In order to overcome, at least slightly, the problem of exaggerated arching of the back and buttocks elevation, a technique used by some lifters is to place the bottom of the feet on the bench surface with the knees bent upwardly, rather than having the feet on the floor. While excessive arching may be lessened somewhat, it should be apparent that the lifter's body is now in a very unstable condition because there is virtually no support for the upper legs.

With the considerable problems relating to stability and support in conventional flat bench constructions in mind, it is a general object of the present invention to provide a novel bench construction for use by an individual lifter reclined thereon which includes a bench top having an upper surface configured with portions anatomically contoured and dimensioned for supporting and least partially restraining the reclined lifter from lateral and longitudinal shifting. More specifically, it is an object of the present invention to form a bench top with an upper surface which includes a lower or foot-end section configured with a first depression contoured for receiving and stabilizing the lifter's buttocks.

Another object of the present invention is to provide a bench top, configured as described above, in which the lower section includes a pair of leg-receiving depressions contoured for receiving and engaging the lifter's upper legs along substantially the entire length of each leg biceps (Biceps femoris). The leg-receiving depressions angle laterally outwardly from the first depression and terminate at the end of the upper surface to enable the lifter's lower legs to drape downwardly for firm foot-floor engagement or contact.

It is yet another object of the present invention to provide a bench top, as described above, in which the upper surface also includes a mid or intermediate section positioned forwardly from the first depression formed as an upwardly extending or elevated section which includes an arch portion defining a support for orienting and positioning the lifter's lower back in a minimally arched condition while still enabling the lifter's buttocks to engage firmly the first depression. The arch portion is dimensioned longitudinally to support the lifter's lower back generally beneath the spine, and subtending the arch portion are laterally-positioned raised regions dimensionally configured for engaging and supporting the lifter's back beneath the latissimus muscles. The elevated section is also formed as a bilateral support for engaging and supporting the lifter's back and trunk beneath the latissimus mucles.

Another object of the present invention is to provide a bench top which also includes a head-receiving member mounted on a flat section of the bench for cradling the lifter's head and thereby stabilizing and restraining same from lateral and longitudinal shifting. The head-receiving member or "headrest" is provided with adjustment means for cooperating with the flat section of the bench to enable selected longitudinal positioning of the headrest to a preselected, comfortable location conforming to the lifter's anatomy.

Further objects and advantages of the present invention will be more appreciated and understood after a consideration of the following drawings and the detailed description of the preferred embodiment.

BRIEF DESCRIPTION OF THE DRAWINGS

FIG. 1 is a generalized side view, shown in perspective, illustrating a lifter reclined on a conventional "flat bench" hoisting a barbell in a bench press movement;

FIG. 2 is a perspective view of a bench construction in accordance with the present invention;

FIG. 3 is a side elevation view of the bench construction of the present invention, sectioned longitudinally, showing a lifter positioned thereon with the lifter's arms in the extended position during a bench press movement;

DETAILED DESCRIPTION OF THE PREFERRED EMBODIMENT

Figure 4:
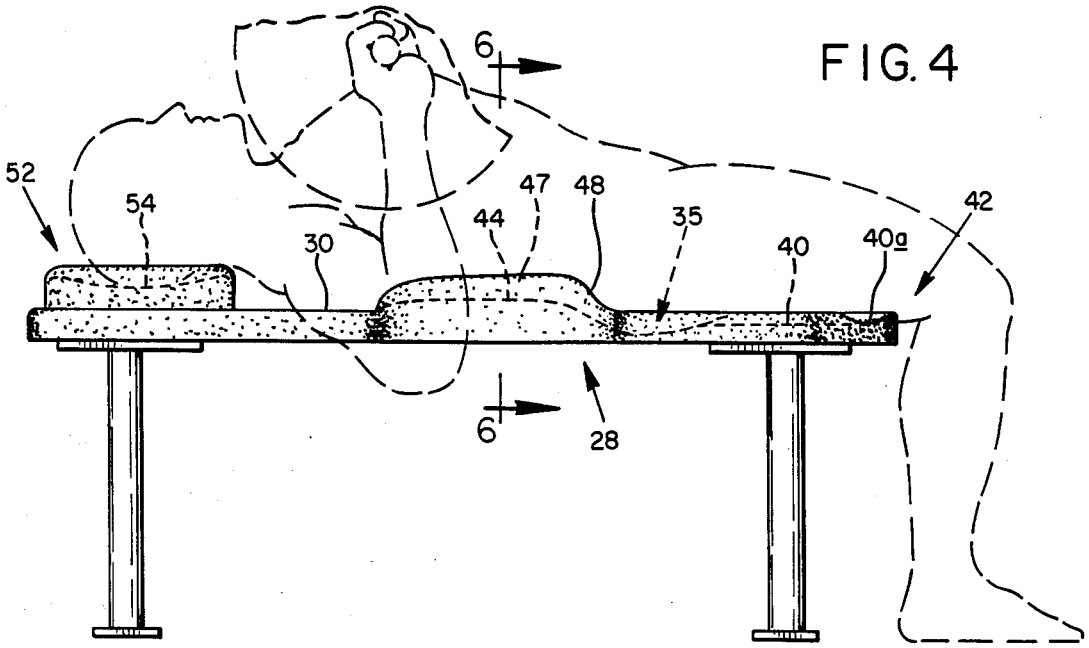
FIG. 4 is a view, similar to that shown in FIG. 3, with the lifter's arms lowered showing the initial pressing position in a bench press movement.

As mentioned at the outset, the present invention is directed to a novel bench construction in which the bench top proper is anatomically contoured and dimensioned for supporting and at least partially restraining a reclined lifter from lateral and longitudinal shifting. Prior to a description of the novel features of the present invention, it is deemed necessary to review briefly the construction of conventional "flat benches" used in the performance of weight-lifting sequences such as the bench press.

A conventional bench construction, generally indicated at 10, is shown in FIG. 1 and includes a flat bench 12 supported by suitable upstanding legs or uprights such as indicated at 14–20. Flat benches, such as that indicated at 12, are constructed with some type of rigid, rectangular form, such as wood, covered by a resilient or foam-like surface overlaid by vinyl or the like to provide for comfort. The legs or uprights are suitably secured to the bottom surface of the bench, and it is typical for such benches to include a weight support "rack" defined by spaced-apart uprights 22, 24 positioned at the head end of flat bench 12. Uprights 22, 24 are provided with retaining "hooks" **22*a*, 24*a***, respectively, for supporting a free-bar with weight plates (barbell) when not in use.

As shown in FIG. 1, a lifter L is reclined on the bench and is holding a barbell, indicated generally at 26, with the lifter's arms in a fully extended, elbows locked position. The lifting position shown in FIG. 1 corresponds to the initial position immediately after the lifter has pushed barbell 26 off the support racks to a starting position above the base of the neck, and also corresponds to the completed position after the press-phase of a bench press movement. It will be observed from FIG. 1 that only three general areas of the lifter's body engage flat bench 12 namely, the back of the lifter's head, a portion of the upper back generally corresponding to the shoulder blades or scapulae and the lifter's buttocks. It will also be observed that the lifter's upper legs, and in particular the portion corresponding to the leg biceps or "hamstrings" do not engage nor are supported by flat bench 12, inasmuch as the legs are straddled for positioning along the sides of the bench so that the lifter's feet may engage the floor.

As such, it should be appreciated that only minimal support is provided to the lifter by flat bench 12, and this support is primarily that of maintaining the lifter's upper body in a generally horizontal orientation. There is virtually no means for restraining the lifter from inadvertent or self-initiated lateral or longitudinal shifting of the body. It can also be seen that the lifter can elevate the buttocks from flat bench 12 to exaggerate the arch between the upper back and buttocks. Indeed, it is also apparent that the lifter may move or angulate the upper legs toward or away from one another during a lifting sequence which will correspondingly move the lower legs and cause unstable foot-floor contact. The entire body of the lifter is unstable, and the lifter must concentrate fully on keeping the head, trunk, buttocks and legs stationary.

Turning now to the present invention, attention is directed to FIG. 2 of the drawings which illustrates a preferred embodiment of applicant's bench construction generally indicated at 28. The bench construction shown in FIG. 2 is not illustrated with barbell support racks for purposes of clarity, and it is to be understood that support racks may or may not accompany such a bench. In any event, bench construction 28 is formed with a bench top means or bench top having an upper surface configured with portions anatomically contoured and dimensioned for supporting and at least partially restraining an individual lifter reclined thereon from lateral and longitudinal shifting during weight lifting movements.

More specifically, the bench construction is formed so that the upper surface includes a first, upwardly facing substantially flat or planar section 30 which oorresponds to the "head end" of the bench top. Planar section 30 is dimensioned with a width generally in the area of 10 inches, suitable for engaging the upper portion of a lifter's back (scapulae and Trapezius) such as shown in FIG. 3. A mid or intermediate section and a lower-body section of the bench top are indicated generally at 32, 34, respectively. The intermediate and lowerbody sections support the lifter's back and trunk, buttocks and upper legs in a manner to be hereinafter described.

Considering lower-body section 34 initially, it will be seen from a viewing of FIG. 2 that it includes a region configured as a first depression 35 having bilaterally-arranged sections 36, 37 for receiving and stabilizing the lifter's buttocks. Sections 36, 37 are formed along opposite sides of the longitudinal axis of the bench top and cojoin to form a type of bowl or "cradle" for engaging the lifter's buttocks. Extending upwardly from lateral portions of each of sections 36, 37 are upwardly extending parts **36*a*, 37*a*** for preventing lateral shifting of the buttocks.

As can be seen from a viewing of FIG. 2 as well as FIG. 3, lower-body section 34 also includes leg stabilizing means configured for engaging the lifter's upper legs to predispose and hold them in a predetermined laterally-diverged orientation. Preferably, the leg stabilizing means takes the form of a pair of leg-receiving depressions 38, 40 anatomically contoured for receiving and engaging the lifter's left and right upper legs, respectively, along substantially the entire length of each leg biceps, i.e. along the back or "hamstring" area of each upper leg. The leg-receiving depressions are elongate and anatomically concave in profile as indicated at **38*a*, 40*a*, and arcuately subtend depressions 36, 37 as at 38*b* so the lifter's upper legs are supported as shown in the top plan view of FIG. 5**. The leg-receiving depressions are dimensioned with a length so that the distal end of the leg-receiving depressions permit the lifter's lower legs to be draped downwardly for firm foot-floor contact.

While it is appreciated that individuals vary in their anatomy, the important point to keep in mind concerning the length of the leg-receiving depressions is that it is only necessary for the major portion of the leg biceps to be supported, inasmuch as the lower legs must be permitted to drape vertically downwardly. The leg-receiving depressions are angled from one another so as to diverge laterally outwardly relative to one another from first depression 35. The divergence of the leg-receiving depressions corresponds generally to the position which the upper legs would normally seek if the lifter were positioned on a flat bench, and a separating or foot end section, generally indicated at 42, defines the angularity between the leg-receiving depressions, and is generally positioned as a planar surface along the same horizontal plane as planar section 30. The angle defined by the longitudinal axes of leg-receiving depressions 38, is generally in the range of 40°–60° or thereabouts.

As mentioned previously, the bench construction of the present invention also incorporates a mid or intermediate section generally designated at 32 which is disposed between planar section 30 and first depression 35. The intermediate section, as shown in FIGS. 2 and 3, is in effect an elevated section extending curvilinearly upwardly from the plane defined by planar section 30 for predisposing the lifter's lower back in an arched posture or condition and also engaging and supporting the lifter's back and trunk beneath the Latissimus dorsi muscles. Arching of the back and "lat" support are accomplished by intermediate section 32 while the lifter's buttocks engage first depression 35.

As can be seen from a viewing of FIG. 3, which is a longitudinal cross section taken along the longitudinal axis of the bench top of FIG. 2, intermediate section 32 includes an upwardly extending arch portion 44 curving upwardly from planar section 30 and correspondingly sweeping downwardly toward first depression 35. The arch portion is situated in intermediate section 32 along a region aligned generally to where the lifter's lower back would be placed when reclined on the bench top as shown in FIG. 3, i.e. along the longitudinal axis of the bench top. The maximum height of the arch, measured from planar section 30 is indicated at H1, and is preferably in the range of $\frac{1}{2}$ to $1\frac{1}{2}$ inches.

Figure 5:
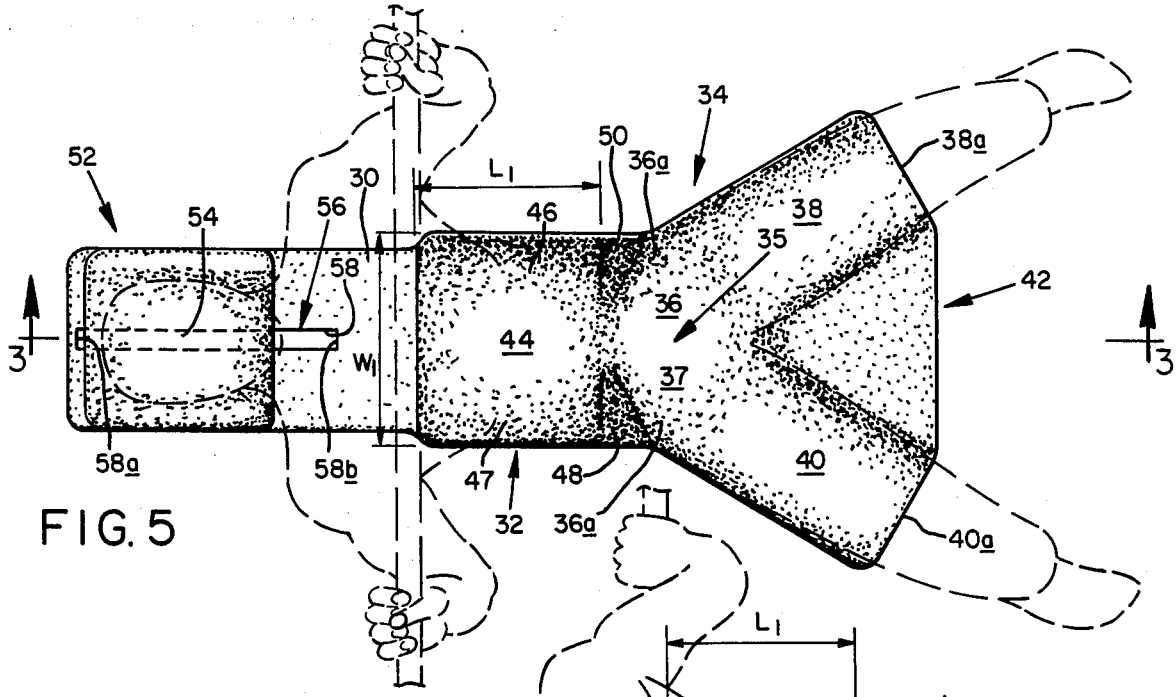
FIG. 5 is a top plan view showing a lifter reclined on the bench of the present invention.
Figure 6:
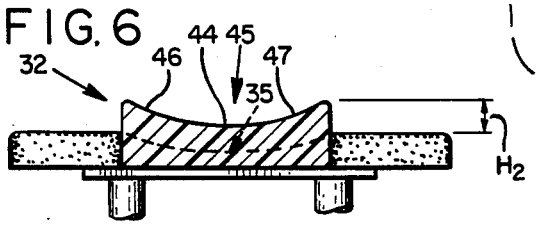
FIG. 6 is a cross-sectional view taken along lines 5—5 of FIG. 4.

As can be seen from a viewing of FIG. 5, the width of intermediate section 32, designated at $W_1$ is dimensioned with a greater overall width than that of planar section 30. The reason for the increased width, which may be generally in the range of 10½ to 12 inches, is to provide a bilaterally-extended surface for engaging and providing uplifting support and lateral stability to the lifter's back and trunk corresponding to the lat muscle region. As shown in FIG. 6, which is a cross-sectional view of intermediate section 32 taken along lines 6—6 of FIG. 4, the intermediate section includes an arcuate expanse, generally indicated at 45, formed with a concave profile, when viewed in lateral cross section, which subtends arch portion 44 defining bilateral support means 46, 47 longitudinally extending from the lower part of the lifter's scapulae (and the Infraspinatus and Teres minor and major muscles) to the lifter's lower back. The concave profile partially "wraps around" the lifter's sides, and is dimensioned above planar surface 30 with a width ($W_1$ in FIG. 5) in the range of 10½ to 12 inches which will support the lat muscles, and with a maximum height, designated at $H_2$, generally in the range of one to two inches above the plane defined by planar section 30 as shown in FIG. 6.

The overall length of the intermediate section, and expanse 45, has been found to be preferably in the range of 10½ to 12 inches which will support the lat muscles from their upper point of origin to their point of insertion adjacent the bottom of the lower back. That length is designated at $L_1$ shown in FIG. 5. Thus, it can be seen that the intermediate section not only predisposes the lifter's back with a comfortable arch for stabilization, generally replicating normal lower back curvature, but also provides a bilateral support means for stabilizing laterally the lifter's back and trunk.

Figure 7:
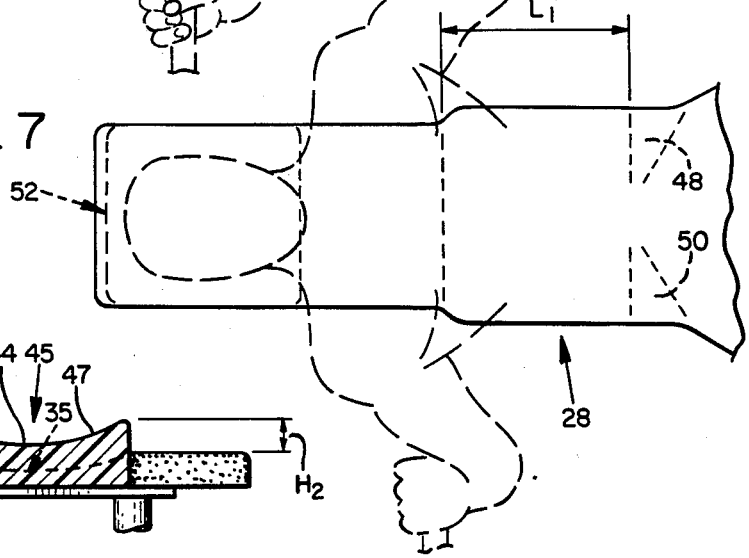
FIG. 7 is a partial view, taken from beneath the bench, showing how the intermediate section of the bench supports the lifter's Latissimus dorsi muscles.

To show more particularly how the intermediate section and bilateral support means 46, 47 are dimensionally configured for engaging and supporting the lifter's back beneath the lats, attention is directed to FIG. 7 which is a partial view looking from beneath the bench showing how the bilateral support means engage the lifter's back immediately below the region corresponding to the location of the lat muscles. Specifically, as can be seen in FIG. 7, expanse 45 is dimensioned with a length $L_1$ which extends from the scapulae to the lower region of the lat muscles. As such, and as can be appreciated from a viewing of FIG. 7, the arms and shoulder blades are positioned for free movement around the edges of planar section 30 so that the lifter has free motion to extend the arms and shoulders somewhat beneath the plane of planar section 30 as shown in FIG. 4—while the lat muscles are being supported in an upwardly extended arched orientation.

Returning to a consideration of FIG. 2, it can be seen that the portion of intermediate section 32 which is most nearly adjacent first depression 35, includes a section which transcends into the first depression by inclined means such as sloping walls, indicated at 48, 50. The sloping walls are dimensionally formed for providing a transition zone between the intermediate section into the first depression and are configured for engaging that portion of the lifter's lower back which is directly above the lifter's buttocks. The lifter's body is thereby comfortably and retainably "nestled" into first depression 35.

Another very important feature of the present invention resides in the provision of a cranial stabilizer or head-receiving member such as a headrest generally indicated at 52, mounted on and longitudinally adjustable relative to planar section 30, as shown in FIGS. 2 and 3. Headrest 52 is formed with a bowl-like depression 54 for cradling the lifter's head and thereby stabilizing and restraining same from lateral and longitudinal shifting. At a lower end of depression 54 there is provided an entry region 55 for supporting and engaging the back of the lifter's neck as shown in FIGS. 3 and 4. The headrest is mounted on flat section 30 by an adjustment means 56 which enables selected longitudinal positioning of the headrest. Explaining further, adjustment means 56 preferably takes the form of an elongate guide means or recess 58 formed on planar section 30 which cooperates with an engagement means or projection 60 extending from headrest 52. The projection is slidably and removably received within recess 58 for travel longitudinally relative to planar section 30 and enables the headrest to be quickly and readily adjusted to a particular lifter's anatomy and preference.

The projection is formed to cooperate with elongate recess 58 in an upwardly, vertically nonrestrained arrangement to enable the headrest to be removed or detached if desired. As can be seen from both FIGS. 2 and 3, elongate recess 58 terminates at a position adjacent the head portion of planar section 30 so that a stop **58*a* is provided with a distal stop being indicated at 58*b*. Thus, when a lifter reclines on the bench, headrest 52 may be shifted into a preselected position with the headrest depression receiving and engaging the back of the lifter's head as well as side portions thereof. Recess 58 is finite in length, as defined by stops 58*a*, 58*b*** for establishing limiting boundaries of longitudinal shifting of the headrest.

The bench construction as described above results in several very important advantages to lifters, whether training or in competitive events in performing bench press or allied weight lifting movements. While the drawings show a lifter reclined in a supine position on the bench top of the present invention, it should be recognized that by suitable modifications, the bench may be inclined so that the head section is disposed upwardly, relative to the lower portion or declined. The bench construction of the present invention may thereby be used not only in conventional supine bench press movements, but also may be used in performing incline or decline pressing movements. In order to appreciate the functional attributes of the present invention, a generalized description of how the bench of the present invention may be used will now be set forth.

Initially, it is presumed that a lifter will perform a bench press movement, i.e. the lifter will be positioned substantially horizontal or in the supine position shown in FIGS. 3–5. The lifter positions the body so that the buttocks are "seated" or cradled in first depression 35 with the upper portions of the left and right legs being supported in leg-receiving depressions 38, 40. The leg-receiving depressions, being elongate and concave in profile, engage the leg biceps of each leg and orient the legs in a stabilized position preventing lateral and longitudinal shifting except in the most exaggerated self-initiated motions by the lifter. The ends of the lower section, indicated at **38*a*, 40*a* are dimensioned for engagement behind the back of the lifter's knees so that shifting of the lifter, relative to the longitudinal dimension of the bench in a direction toward the head end of the bench is substantially prevented. This is to be contrasted with the unsupported position of the lifter shown in FIG. 1**, whereby the lifter's leg biceps have no bench restraint to limit undesired movement of the legs during a lift.

Moreover, with the lifter's buttocks supported in first depression 35, it can be seen that arch portion 44 of intermediate section 32 engages the lifter's lower back longitudinally beneath the spine to orient the back in a slight arch, generally corresponding to the natural curvature of the lower back. The bilateral support of expanse 46 with its laterally upwardly extending portions, engages the lifter's back firmly beneath the lat muscles to orient these muscles upwardly so that the lifter may feel firmly supported. Lastly, the headrest, being adjustable permits the lifter to have the head "locked-in" for stability.

The advantages to the above construction are numerous and can be grouped into several generalized categories, namely:

(1) increased safety;
(2) enhanced biomechanical technique and training effect;
(3) protection against aggravating current injuries;
(4) adaptability for use with other weight lifting movement; and
(5) conversion of already-existing flat benches.

With respect to safety, it has been pointed out previously that lifters, whether in training or in competition, may shift their bodies relative to a flat bench which can increase the chance of injury, an eventuality which is substantially eliminated by the anatomically configured bench top of the present invention. With a lifter "locked-in" in the bench top of the present invention, substantial lateral and longitudinal shifting of the lifter's body is all but prevented unless the lifter initiates a very exaggerated motion. The lifter's entire body, except for the shoulders and arms, are stabilized in an optimal position, i.e. a proper arch is formed in the lifter's back, the lat muscles are supported and the legs and buttocks are also supported and stabilized. Thus, if a lifter has an injured shoulder, arm or lat muscle, it is not readily possible for the lifter to laterally shift to one side of the bench or another which would create an undue strain on that unsupported body portion.

For example, a lifter may have an injured shoulder or lat muscle and if permitted to shift the injured area off of the bench, as could occur with a flat bench, that injury would be aggravated because of the lack of support beneath the injured muscle. With the bench of the present invention, such shifting is substantially prevented. Moreover, from the standpoint of preventing injuries, it is to be recognized that many lifters, when performing a bench press, instinctively want to raise the buttocks from the bench and dangerously arch the back which causes substantial stress on the vertebrae. With the bench construction of the present invention, the lifter "feels" support with a natural, supported arch being formed, thereby giving the lifter more confidence and eliminating the need, at least from a psychological standpoint, of excessively arching the back. Obviously, the chances of injury are lessened and enhanced technique results.

Another safety problem arising from improper technique, is the practice of "bouncing" the bar off the chest during the down-phase. While a controlled, slow lowering of the weight is really up to the lifter, it is not unusual for a muscle to be strained, especially during a one-rep maximum attempt. With the trunk and lats being supported, the lifter has enhanced control and a greater degree of safety by using the bench top of the present invention.

Indeed, the present bench top not only assists technique, but also increases the actual training effect. Specifically, if a lifter arches the back to an exaggerated extent, the training effect of the bench press movement, which is to increase primarily the strength of the pectorals, is decreased. This is because the greater the arch, the greater the stress on the lat muscles under the arms, and the strain on the pectorals becomes lessened. While it may be that perhaps more weight can be hoisted, the purpose of exercising primarily the pectorals is diminished.

The construction of the intermediate section of the bench top of the present invention orients the lifter's back in a preferred mode and serves as a guideline for the extent of arch which is desired. The lifter knows automatically that if the back disengages from the arch portion of the intermediate section, too much arch and therefore an excessive amount of stress is being placed on the lat muscles. A lifter has no analogous "feel" on a conventional flat bench because the lifter's lower back never touches the flat bench—unless the lifter unnaturally exerts effort to bow the back outwardly.

In addition, from the standpoint of enhanced technique and training effect, the present invention prevents a lifter from lateral and longitudinal shifting, i.e. the lifter's body is maintained in a predisposed orientation thereby enabling the lifter to concentrate fully on the down- and press-phases of the weight. Furthermore, the lifter's head, by virtue of it being nested in the headrest, also is relatively rigidly stabilized thereby enabling the lifter to concentrate, especially through direct eye contact with the free-bar during the lifting motion to create proper form.

It should also be appreciated that the bench top construction of the present invention is readily adaptable for use by lifters performing exercises other than a bench press in either the supine, incline or decline positions. For instance, a particularly efficacious adjunct exercise for working the pectorals is a movement called "dumbbell flys." In that exercise, a reclined lifter grabs a dumbbell in each hand and swings them from outwardly extending horizontal positions upwardly above the chest until the dumbbells touch, the dumbbells are lowered and the movement repeated. Such a movement naturally causes the lifter's body to shift laterally on a flat bench, and is substantially prevented by the bench top construction of the present invention.

Moreover, other exercises such as triceps extensions may also be employed, i.e. the type of exercise where a relatively light-weight barbell is touched to the forehead of a reclined lifter and then extended upwardly by virtue of the action of the back of the arms or triceps. In triceps extensions, it is common for a lifter to shift longitudinally, as well as laterally on the bench, a condition which is substantially eliminated by the construction of the present invention.

Lastly, it should be appreciated that the bench construction of the present invention may be retrofitted for use on conventional flat top benches. While the bench top is shown in the drawings as being supported on uprights, it is possible to form the bench top as an integral unit with suitable flanges or other fastening means for fitting on top of an existing flat bench. The bench top of the present invention may be formed as a unitary member molded out of fiberglass or other suitable synthetic material or, if the need be required, formed out of other materials.

While the present invention has been shown and described with reference to the foregoing preferred embodiment, it will be understood readily by those skilled in the art that other changes in form and detail may be made therein without departing from the spirit and scope of the invention as defined in the appended claims.

It is claimed and desired to secure by Letters Patent:

1. A weight-lifting bench for use by an individual lifter reclined thereon in performing weight lifting movements comprising:

an elongate bench top means for supporting the lifter's trunk and upper legs and support means supporting the bench top means in an elevated position above the floor whereby the lower legs of the lifter may drape to the floor;

said bench top means being contoured for engaging and stabilizing the lifter's trunk and upper legs and including a first, substantially planar section for engaging the lifter's scapulae, a lower-body section including a buttock support region and a pair of shallow channel-like leg-receiving depressions connecting with the buttock support region and extending therefrom in directions diverging from each other and laterally outwardly from the longitudinal axis of the bench top means, said leg-receiving depressions each having a concavity disposed transversely of the direction that the depression extends and being anatomically contoured for stabilizing the lifter's upper legs by engaging a major portion of each leg biceps so that each upper leg is predisposed in a predetermined outwardly diverging orientation, and an intermediate section disposed between the planar and lower-body sections defined by a bilateral support means for engaging and supporting the lifter's back and trunk beneath the Latissimus dorsi muscles, the intermediate section being elevated relative to the planar and lower-body sections.

2. The bench construction of claim 1 wherein the leg-receiving depressions are predetermined lengthwise to enable the lifter's legs to drape downwardly for substantially flat-foot contact.

3. The bench construction of claim 1 wherein the intermediate section includes an upwardly extending arch portion defining a support for orienting and positioning the lifter's lower back in an arched posture.

4. The bench construction of claim 3 wherein the arch portion is dimensioned longitudinally to support the lifter's lower back generally beneath the spine.

5. The bench construction of claim 4 wherein the intermediate section also includes bilateral support means dimensionally configured for engaging and supporting the lifter's back beneath the Latissimus dorsi muscles.

6. The bench construction of claim 4 wherein the bilateral support means is formed with a concave profile, when viewed in lateral cross section, subtending the arch portion of the intermediate section defining an expanse longitudinally extending generally from the region corresponding to the bottom of the lifter's scapulae to the lifter's back.

7. The bench construction of claim 6 wherein the buttock support region is a depression having a concavity which extends tranversely and longitudinally of the bench top means and is contoured for receiving and stabilizing the lifter's buttocks.

8. The bench construction of claim 7 wherein the intermediate section transcends into the buttock support region by inclined means dimensioned for providing a transition zone between the arch portion and the buttock support region.

9. The bench construction of claim 1 further including a head-receiving member mounted on the planar section for cradling the lifter's head and thereby stabilizing and restraining same from lateral and longitudinal shifting.

10. The bench construction of claim 9 further including adjustment means for enabling selected longitudinal positioning of the head-receiving member.

11. The bench construction of claim 10 wherein the adjustable means is defined by a guide means disposed on the flat section oriented to cooperate with an engagement means disposed on the head-receiving member.

12. The bench construction of claim 11 wherein the guide means is defined by an elongate recess formed on the flat section, and wherein the engagement means is defined by a projection slidably and removably received within the recess for travel longitudinally relative to the flat section.

* * * * *